United States Patent [19]

Rauser et al.

[11] Patent Number: 4,920,354

[45] Date of Patent: Apr. 24, 1990

[54] MANUALLY EXTENDABLE TELESCOPING ANTENNA

[75] Inventors: Bernard Rauser, Gaimersheim; Robert Harth, Ingolstadt, both of Fed. Rep. of Germany

[73] Assignee: Audi Ag, Ingolstadt, Fed. Rep. of Germany

[21] Appl. No.: 127,195

[22] Filed: Dec. 1, 1987

[30] Foreign Application Priority Data

Dec. 12, 1986 [DE] Fed. Rep. of Germany ..... 3641530

[51] Int. Cl.[5] ..... H01Q 1/10

[52] U.S. Cl. ..... 343/901; 343/DIG. 1

[58] Field of Search ..... 343/900, 901, 903, DIG. 1

[56] References Cited

U.S. PATENT DOCUMENTS

| | | | |
|---|---|---|---|
| 2,179,415 | 11/1939 | Mace | 343/901 |
| 2,346,728 | 4/1944 | Carlson | 343/903 |
| 2,366,299 | 1/1945 | Benschoten | 343/903 |
| 2,456,330 | 12/1948 | Scott | 343/901 |

FOREIGN PATENT DOCUMENTS

| | | | |
|---|---|---|---|
| 755893 | 8/1951 | Fed. Rep. of Germany | 343/901 |
| 1064575 | 5/1954 | France | 343/903 |
| 1081711 | 12/1954 | France | 343/903 |

*Primary Examiner*—Rolf Hille
*Assistant Examiner*—Michael C. Wimer
*Attorney, Agent, or Firm*—The Dulin Law Firm

[57] ABSTRACT

Manually extendable telescoping antenna for a vehicle or vessel having a continuous core provided in the interior of the antenna to reduce mechanical/wind generated vibration noises. With the antenna extended, the core loosely touches the insides of the hollow telescoping elements and thus dampens and prevents creating a propagation of eigen-vibrations into the vehicle or vessel interior. The preferred core configuration may be a plastic band, plastic coated wire, or hollow or foam-filled plastic tube formed in a helical spiral secured at its lower end to a guide tube and at its upper end to the solid rod upper antenna section.

9 Claims, 1 Drawing Sheet

MANUALLY EXTENDABLE TELESCOPING ANTENNA

1. Field

The invention pertains to manually extendable telescoping antennas mountable on vehicles, vessels and other objects subjected to relative motion with respect to the wind, and more particularly to antennas having a vibration absorbing and damping core disposed to extend interiorly of the telescoping tubes as a continuous unit from an upper antenna rod to a lower antenna guide tube, and which follows the extension and retraction motions of the antenna while loosely touching several regions thereof.

2. Background

Telescoping antenna are well known in the art. Simple, low-cost hand extensible models consist of several telescoping tubes inserted inside each other which act as guide casings (excepting the innermost piece) for the upper piece. When retracted, the casings are held in a guide tube mounted under the vehicle body surface.

In addition, well-known motor-driven telescoping antennas have a heavy electric motor located at the lower end, which motor extends and retracts the antenna electrically by moving a retraction/extension member, e.g., a nylon cord, up and down.

When driving, the acoustic behavior of manually extended telescoping antennas is very poor. They tend to produce wind noise which enters the interior of the vehicle.

Antennas equipped with an electric motor are less susceptible to such wind noise because of their heavy electric motor located in the lower region.

German patent 28 46 344 proposes to reduce antenna wind noise by a special shaping of the circumference of the antenna, since it had heretofore been assume that the whirring and whistling antenna noises were caused predominantly by the antenna generating wind eddys and turbulence. The fact that motor antennas exhibit less wind noise is because the heavy counterweight of the motor causes a better mass equilization and the antenna accordingly tends to vibrate less.

The general idea to use a core in the interior of antennas is also known. U.S. Pat. No. 2,456,330 describes an internal pretensioned steel spring core. This steel spring is intended to clamp the individual telescoping segments together to prevent vibrations and fluttering of the antenna. But due to the tensioning provided, this spring steel repeats and amplifies wind-generated vibrations rather than being able to reduce them. Also, the steel spring does not extend as a single continuous piece through the entire telescoping antenna.

German patent 894,578 describes a vehicle antenna using inserts between internal tubes and outer tubes, which likewise serve to prevent rattling noises.

U.S. Pat. No. 2,179,472 and U.S. Pat. No. 2,179,415 also describe inserts which are designed to tension the individual telescoping tubes against each other in order to overcome the play necessary for extension and retraction, and in order to prevent mechanical, metallic rattling of the telescoping tubes within each other.

None of these approaches has significantly solved the problem of travel (or relative air motion) wind-induced antenna vibration that is amplified by the vehicle body paneling and transmitted to the interior where the occupants are subjected to it. There is thus a need in the art for a simple, effective device to reduce antenna wind vibration noise.

THE INVENTION

OBJECTS

It is an object of the invention to create a manually extendable or powered telescoping antenna whose acoustic behavior is improved over state-of-the-art antennas of these types.

It is another object to provide a simple and effective antenna vibration damping assembly that is particularly adaptable for use in manual vehicle antennas.

It is another object of the ivnention to provide an improved antenna having low vibration characteristics that does not require special sleeves or pretensioned core inserts.

Still other objects will be evident from the specification, claims and drawings which follow.

THE DRAWINGS

The invention is explained below with reference to the drawings, in which.

SUMMARY OF THE INVENTION

The invention is based on the discovery and recognition that the actual source of antenna noise does not reside in the rattling of segments with respect to each other, and also not in the release of wind eddys and turbulence, which consequently would have to be prevented, but rather the eigen-vibrations of the antenna generated by the release of wind eddys and turbulence are transmitted via the antenna base to the sheet metal body, amplified there in certain designs, and then fed as body noise into the vehicle. In particular, the whistling and buzzing in the wind is attributable to such causes.

In recognition of these conditions, a simple means was sought to suppress or reduce the eigen-vibrations of the antenna. The invention solves the problem by providing a substantially untensioned core member loosely touching several regions of the telescoping tube to damp the vibrations, and thus no noise is induced in the body by the antenna base nor transmitted by the body sheet metal to the vehicle occupants in the interior.

Accordingly, the invention comprises a manually extendable telescoping antenna which has an internal core, e.g. a band, a coated or uncoated tube or wire, or the like, which is disposed to touch the inside walls of the individual telescoping tubes when the antenna is extended. The core extends from the top antenna telescoping section down to the lowest telescoping section, preferably down to the lower end of the guide tube. Such a core results in a great reduction of noise, as discussed in detail below.

The core material is of secondary importance for operability. A plastic band, a plastic-coated metal band or tube may be used. It is preferred to have a material that has the greatest possible internal damping.

In order to take up as little space as possible when in the collapsed state, and to insure the core touches several points of the telescoping sections interior walls reliably when in the extended state, the core can be of spiral or helical design.

In order to reliably prevent lock-up after continuing operation and penetration of moisture, it is preferred to provide the core with an outer, friction-reducing material, e.g. polytetrafluorethylene.

DETAILED DESCRIPTION OF THE BEST MODE OF CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
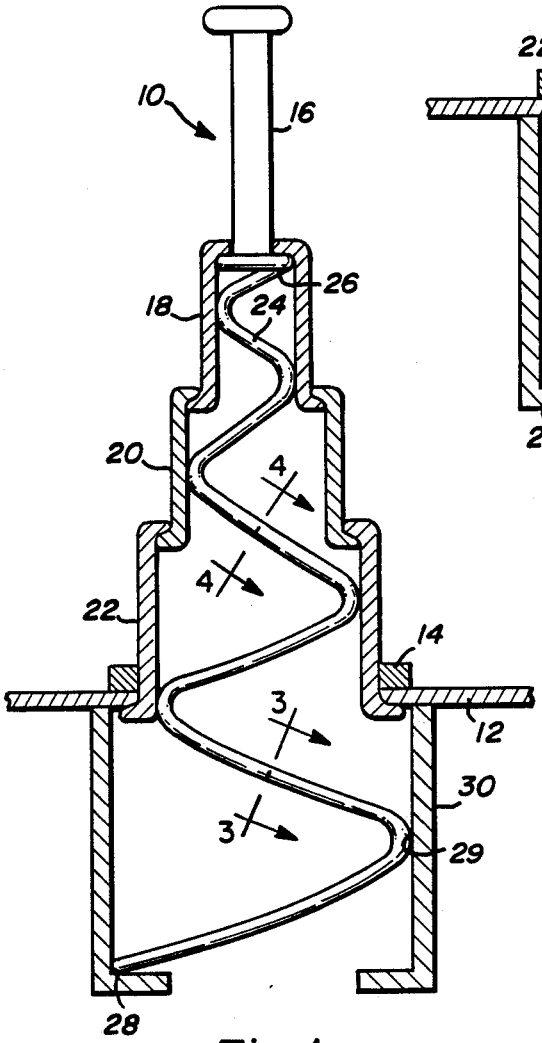
FIG. 1 is a side elevation view partly in section of a telescoping antenna of the invention when extended.
Figure 2:
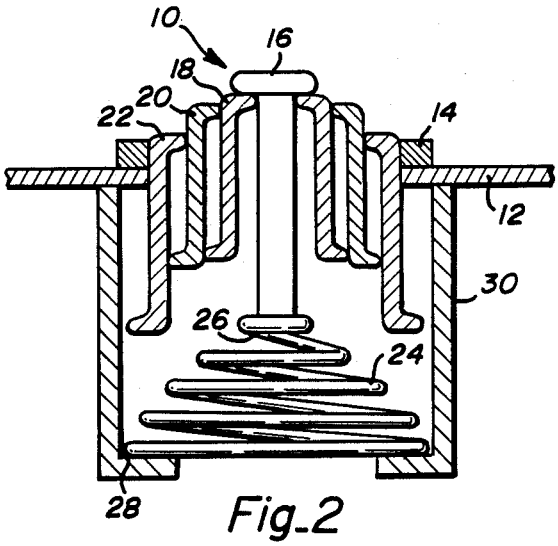
FIG. 2 is a side elevation partly in section of a telescoping antenna of the invention when retracted.

The telescoping antennas shown in FIGS. 1 and 2 are not drawn to scale, but are greatly widened horizontally, in order to illustrate the principles of the invention more clearly. The details of construction and operation of known tubes telescoping inside each other, and the allocation of telescoping tubes and guide tube, have been omitted in order to simplify the illustration.

Referring to the figures, the telescoping antenna 10 is mounted in a surface, e.g. the sheet metal body 12 of a vehicle or vessel, and secured by a ring 14. Vibrations of the antenna 10 are fed via the ring 14 and/or tube 22 into the sheet metal 12 and propagated as body noise into the interior of the vehicle.

The telescoping antenna 10 consists of an upper, usually solid rod 16 to which several, typically three or more, additional telescoping tubes 18, 20 and 22 are inter-connected as shown schematically in the drawing. For simplification, guide pieces provided in the actual designs are not mentioned in this description and are not shown in the drawing. A lower guide tube 30 surrounds the retracted and collapsed telescoping antenna and is located beneath the sheet metal body 12.

Core 24 is secured at point 26 to the lower end of the solid upper piece 16. The other end of core 24 is fixed in the lower section of the guide tube 30 at point 28.

This core 24 is not highly pretensioned and moves loosely through the interior of the antenna being disposed to touch the interior walls of the telescoping tubes 18, 20 and 22 in several regions, and also at one or more places (e.g. 28 and/or 29) on the interior wall of the guide tube 30. A spring pretension is not desired; the damping effect of the core is better if it has no eigen-vibration properties.

The core 24 can consist, for example, of insulated metal wire which is provided long enough to touch the inside walls of the telescoping tubes 18, 20 and 22, even with the antenna 10 extended. It is preferred to form the core, in this case a metal wire, in a loose helical spiral or coil.

Figure 3:
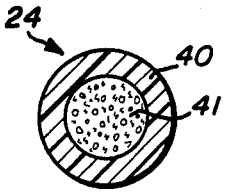
FIG. 3 is a section view of a foam-filled core taken along line 3—3 of FIG. 2.
Figure 4:
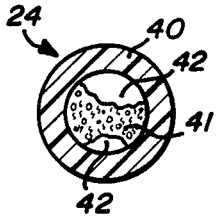
FIG. 4 is a section view of a partially foam-filled core taken along line 4—4 of FIG. 2.

Various other materials may also be used, e.g. a pure plastic band (which may be polygonal in cross-section), a plastic cord, a plastic tube (hollow or plastic foam filled, or at least partially filled), plastic spirals or the like, as long as sufficient damping properties exist. FIG. 3 is a section view of the core 24 taken along 3—3 of FIG. 2 showing a hollow plastic tube 40 filled with a foam plastic 41. FIG. 4 is a section view of the core 24 taken along line 4—4 of FIG. 2 showing a hollow plastic tube 40 partially filled with a foam plastic 41, voids being identified as 42. The core within the extended antenna 10 can be under some light tension, but it is important that it touches the telescoping tubes at several points.

A friction-reducing surface coating on the core, or the core itself being made of a friction-reducing material is advantageous for mechanical reasons. This is independent of the desired acoustic damping properties. In designing the core 24, it must be taken into account that in constant operation, after several years it must still be ensured that the antenna can be extended and retracted without difficulty.

It should be understood that various modifications within the scope of this invention can be made by one of ordinary skill in the art without departing from the spirit thereof. We therefore which our invention to be defined by the scope of the appended claims as the prior art will permit, and in view of the specification if need be.

We claim:

1. In a manually operated telescoping antenna assembly having a plurality of nested hollow telescoping tubular sections, an upper terminal section having an upper end and a lower end, and a lower guide tube mountable to a substantially planar base member into which the antenna sections receivably retract and from which said antenna sections are manually extensible, the improvement which comprises in operative combination therewith of:

(a) a continuous one piece vibration damping non-electrically conductive core member disposed inside said hollow telescoping sections;

(b) said lower guide tube is mounted below the plane of said base member so that said antenna sections are manually retracted to a position substantially flush with said base member plane;

(c) said vibration damping core member extending continuously from said upper terminal section into said lower guide tube;

(d) said core member:

(i) is fixed adjacent an upper end thereof to the lower end of said upper antenna terminal section;

(ii) terminates in said guide tube; and (iii) is fixed at a lower end thereof to said guide tube;

(e) said continuous vibration damping core member is formed in a generally helical spiral having a large spiral diameter portion oriented to be received in said guide tube, said vibration damping core member maintaining a helical spiral configuration in all retracted and extended positions;

(f) said core member being of sufficient length and flexibility:

(i) to permit said vibration damping core member to move loosely, and to be extended and retracted, without eigen vibration properties in a helical spiral configuration during extension from said guide tube and retraction of said antenna sections; and (ii) to touch each of said telescoping tubular sections non-continuously but in at least one place per antenna section when extended in order to dampen motion and wind-induced eigen vibrations of said antenna sections, to reduce transmission of said vibrations as noise to a base member to which said antenna assembly is mounted, and to reduce propagation of noise vibrations by said base member to which said antenna assembly is mounted; and (g) said core member being of insufficient length and of sufficient flexibility, and disposed entirely within said telescoping sections and said guide tube, to exclude power raising of said antenna sections by power drive means acting on said flexible vibration damping core member, while permitting manual raising and lowering of said antenna by lifting or pushing, respectively, on said upper terminal section.

2. Telescoping antenna as in claim 1, wherein said vibration damping core member comprises a metal member coated with a solid organic material.

3. Telescoping antenna as in claim 1, wherein said vibration damping core member comprises a plastic member.

4. Telescoping antenna as in claim 3, wherein said plastic member is in the form of a tube in cross section.

5. Telescoping antenna as in claim 4 wherein said tube is hollow.

6. Telescoping antenna as in claim 4 wherein said tube is at least partly filled with a foam plastic material.

7. Telescoping antenna as in claim 3 wherein said plastic member is in the form of a band, polygonal in cross section.

8. Telescoping antenna is in claim 1 wherein said core has an exterior coating of a solid friction-reducing material.

9. Telescoping antenna as in claim 8 wherein said core has an external coating of polytetrafluorethylene.

* * * * *